United States Patent [19]

Hoffmann

[11] 4,214,149

[45] Jul. 22, 1980

[54] HAND-HELD BLOW DRYER WITH THUMB-OPERABLE CONTROLS

[75] Inventor: Karl-Heinz Hoffmann, Wehrheim, Fed. Rep. of Germany

[73] Assignee: Braun Aktiengesellschaft, Frankfurt am Main, Fed. Rep. of Germany

[21] Appl. No.: 960,715

[22] Filed: Nov. 14, 1978

[30] Foreign Application Priority Data

Nov. 15, 1977 [DE] Fed. Rep. of Germany ..... 2750954

[51] Int. Cl.[2] ..... H05B 1/00

[52] U.S. Cl. ..... 219/370; 34/97; 219/364; 338/70

[58] Field of Search ..... 219/501, 364, 368–382; 34/96–98, 243 R; 139/9, 11 R; 338/68, 69, 70, 67

[56] References Cited

U.S. PATENT DOCUMENTS

| | | | |
|---|---|---|---|
| 3,379,871 | 4/1968 | Peek, Jr. | 338/70 |
| 3,450,941 | 6/1969 | Butts | 338/70 |
| 3,946,200 | 3/1976 | Juodikis | 219/501 |
| 4,085,309 | 4/1978 | Godel et al. | 219/501 |

FOREIGN PATENT DOCUMENTS

| | | | |
|---|---|---|---|
| 2327622 | 12/1973 | Fed. Rep. of Germany | 219/370 |
| 2307922 | 8/1974 | Fed. Rep. of Germany | 219/370 |
| 647291 | 12/1950 | United Kingdom | 219/364 |
| 767736 | 2/1957 | United Kingdom | 219/369 |

*Primary Examiner*—B. A. Reynolds
*Assistant Examiner*—Bernard Roskoski
*Attorney, Agent, or Firm*—Karl F. Ross

[57] ABSTRACT

The housing of a blow dryer has a slender handle shaped to be held in the hand and formed with a pair of windows on the back side, and a large head formed with an outlet. A blower motor is mounted in the handle and carries a fan in the head which blows air past a heater through the outlet. A control circuit housed in the handle is connected to a pair of control elements mounted rotationally on the motor casing and operable through the windows at the back of the handle. One of these controls varies the motor speed and the other establishes the output temperature. The two adjustment members are rotatable about the motor axis, with the temperature-adjustment member formed with teeth connected to a gear carried on a potentiometer and the motor-speed adjustment member connected via an axially extending finger to a motor-speed switch.

10 Claims, 2 Drawing Figures

HAND-HELD BLOW DRYER WITH THUMB-OPERABLE CONTROLS

FIELD OF THE INVENTION

The present invention relates to a blow dryer. More particularly this invention concerns such a dryer which is of small size so that it can be held in the hand while being used.

BACKGROUND OF THE INVENTION

A hand-held blow dryer normally has a relatively smooth handle that can easily be grasped by the user and a relatively large head. As described in German Pat. publications Nos. 2,307,992 and 2,327,622 it is standard practice to provide the housing of this unit with a blower whose fan is provided in the head of the dryer along with a heater. A motor rotates the fan to force a current of air over the heater and through an outlet of the housing. This heated current of air is directed at the head of the user for drying and styling of his or her hair.

Such a dryer always has an on and off switch, and is usually provided at least with a blower-speed control, normally in form of a multiposition switch provided on the side of the handle. It is also known to provide some sort of temperature regulation on the handle or on the side of the device, normally in the form of a multiposition switch.

Such systems all have the considerable defect that it is not an easy operation to manipulate the controls. The user must reposition his or her hand on the device to operate the controls, or use the other hand to operate them. Attempts to provide the controls in convenient locations result normally in placing them in locations which make the dryer hard to hold, and where accidental actuation of these controls is a common occurrence.

OBJECT OF THE INVENTION

It is therefore an object of the instant invention to provide an improved blow dryer.

Another object is to provide such blow dryer with controls which can be easily operated with the same hand the user is employing to hold the dryer.

SUMMARY OF THE INVENTION

These objects are attained according to the instant invention in a blow dryer having a housing of the above-described general type provided with blower means including an electric motor in the handle having an output shaft and a motor casing formed generally as a body of revolution, and a fan mounted on this shaft and rotatable by the motor to blow air from the outlet of the housing. Heater means in the housing is electrically energizable to heat the air blown by the fan. A circuit including a variable circuit element connected either to the blower or the heater is also connectable to a source of electricity and through the circuit element to the means controlled by the variable circuit element for varying the energization of this means. An adjustment member is carried on the motor casing and is rotatable about the axis thereof. The housing is formed with a window at which this adjustment member is exposed and through which it can be operated. A formation on the adjustment member links it to the variable circuit element for operation of the heater or blower means by this adjustment member. Thus a simple rotary element journaled on the motor casing can serve to control either the motor or the heater.

More specifically in accordance with this invention the housing is formed with a pair of such windows at each of which is exposed a respective adjustment member. One of them constitutes the motor-speed selection switch, and can incorporate an on-off switch, and the other serves for temperature adjustment. Appropriate circuitry such as described in the commonly owned and copending patent application Ser. No. 960,756 filed Nov. 14, 1978; connects the variable circuit elements to the respective controlled elements.

Thus with the system according to the instant invention it is possible for the operator very easily to control the blower speed and the air temperature independently of each other simply by operating the respective adjustment member with his of her thumb. Indeed, such adjustment can be carried out during the use of the blow dryer, so that the user can increase or decrease the temperature while using the dryer without having to stop drying.

In accordance with further features of the instant invention each of these adjustment members is formed as a ring surrounding the cylindrical motor casing. The housing is formed with a pair of inwardly open grooves each receiving a respective one of the rings. Thus the rings ride on the motor casing which in turn is prevented from rotating at its axial ends. This extremely compact expedient allows adjustment members to be used having a relatively long travel, here measured angularly, without in any way increasing the size of the unit. In fact it is possible for the dryer according to this invention, even with steplessly adjustable temperature control and a multispeed blower, to be more compact than prior-art units having less controls.

In accordance with this invention the one ring is connected by means of an axially projecting finger with a high-low speed switch for the motor. The other ring is provided with external teeth which mesh with a gear carried on a potentiometer that operates the circuit that establishes the output air temperature in accordance with the above-cited copending application.

The axis of the shaft motor extends longitudinally of or parallel to the slim handle of the housing and the fan is mounted directly on this output shaft. Furthermore the housing is formed with inlet openings at the head part and also at the bottom end of the handle, and the handle forms a passage over the circuit elements and motor. Thus as the motor operates it draws in ambient air through these inlet openings and cools its heat-generating parts. In this manner the circuitry can be nounted in the handle adjacent the motor without having to provide insulation to prevent this handle from becoming too warm to hold.

SPECIFIC DESCRIPTION

Figure 1:
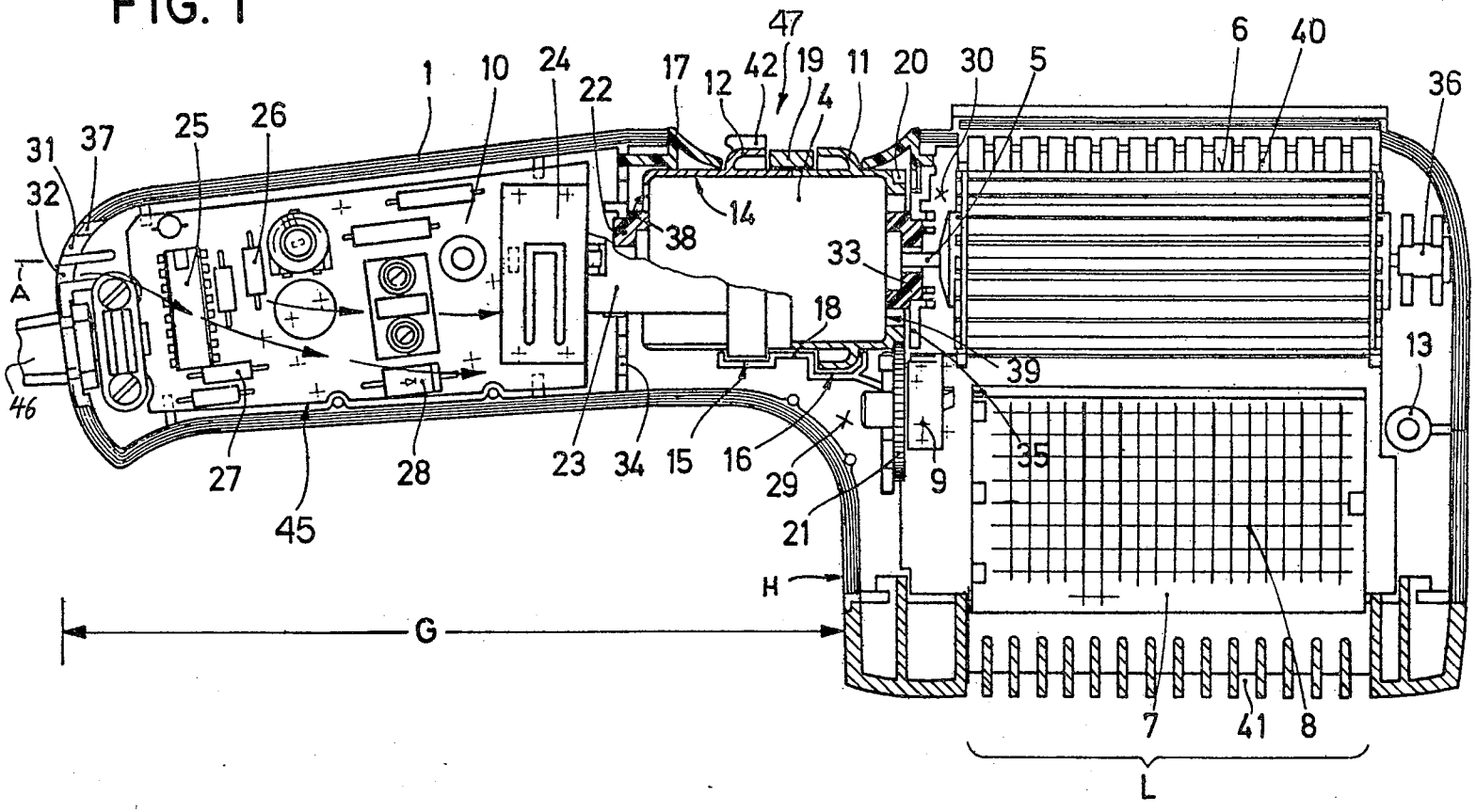
FIG. 1 is a longitudinal section through the dryer according to this invention.
Figure 2:
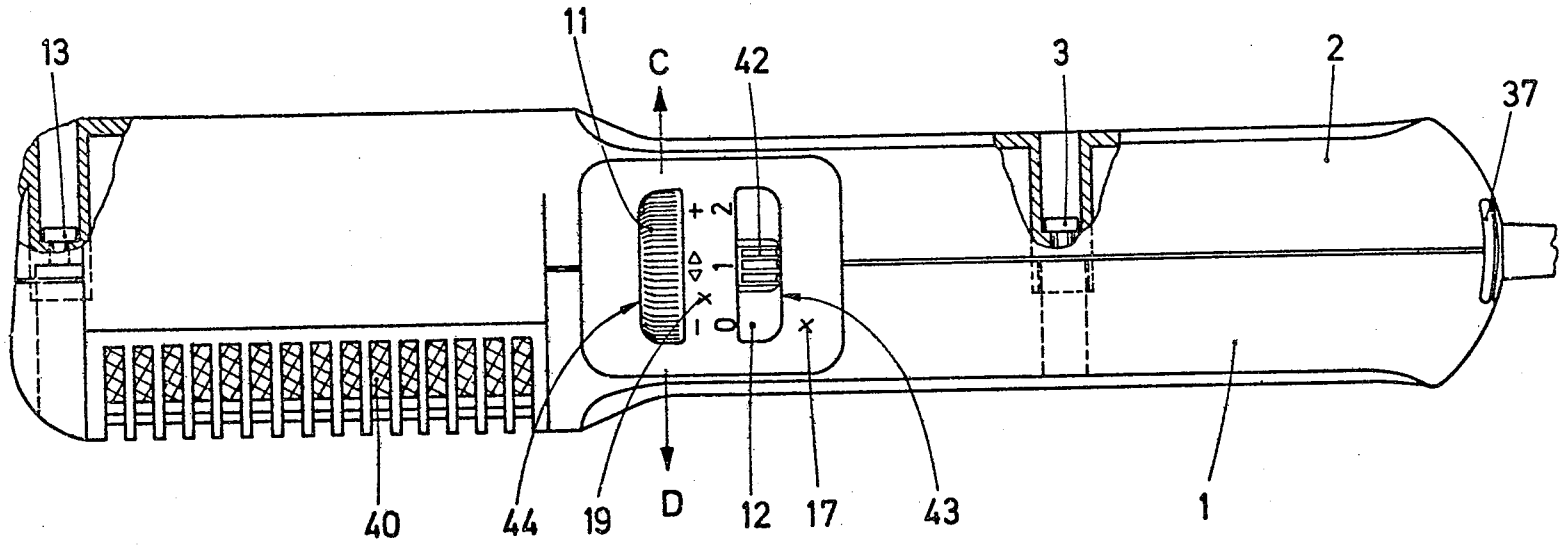
FIG. 2 is a back view partly in section through the dryer of FIG. 1.

The blow dryer according to this invention as shown in FIGS. 1 and 2 has a housing formed of a pair of generally specularly similar housing halves 1 and 2 and a recess-forming insert 17. Screws 3 and 13 secure the parts 1 and 2 together and webs 34 and 35 formed in the parts 1 and 2 lock the insert 17 in place. The housing is basically divided into a handle part G extending generally along an axis A and a head part H. The handle G and the head H form respective chambers 29 and 30 and are formed with inlet openings 31, 32 and 37. In addition the head H is formed with an outlet opening 41 having a width L.

The handle G houses a printed circuit 45 having a circuit board 10 extending longitudinally along the axis A and carrying a motor-speed switch 24, an integrated circuit 25, various resistors 26 and 27, a diode 28, and other electrical and electronic circuit elements. Furthermore a potentiometer 9 is connected to this circuit board 45. For more details about this circuit 45 reference should be made to FIGS. 3, 4, and 5 of the above-cited application. In this context it is noted that motor-speed switch 24 of FIG. 1 of this application is shown at 12 and 21 in FIG. 3 of the above-cited pending application and the potentiometer 9 of this application is the equivalent of potentiometer 32 shown in FIG. 3 of the copending application.

The dryer has an electric motor 4 whose output shaft 5 defines the longitudinal axis A for the housing and carries a fan 6 mounted at its far end in a bearing 36 formed in the head part. The motor 4 has a casing 14 of cylindrical shape centered on the axis A and secured at its ends 38 and 39 in respective torque mounts 22 and 33 carried in the webs 34 and 35. The motor can be operated at two speeds by full-wave or half-wave rectification of electricity fed into the device via a line cord 46. A heater 8 downstream of the fan 6 is carried on a plate 7 adjacent the outlet 41 of the housing. When rotated the fan 6 draws air in through inlet holes 31, 32, and 37 at the far end of the handle G and also via holes 40 in the back of the handle H. The air passing axially through the passage or chamber 29 of the handle H serves to cool the circuit elements 24–28.

The insert 17 forms a recess at the back of the handle G formed in turn with a pair of windows 43 and 44. Rotatably mounted on the motor are rings or sleeves 11 and 12 constituting adjustment members respectively for the temperature and the blower speed. To this end the housing is formed with grooves 15 and 16 opening inwardly at the ring parts of the adjustment members 11 and 12 so that these members can rotate freely about the axis A on the motor casing 14. A web 18 of the housing insert 17 interconnects the webs forming the grooves 15 and 16 and this web extends at 19 between the windows 43 and 44.

The adjustment member 11 for the temperature is formed with an array of gear teeth 20 centered on the axis A and meshable with the teeth of a gear 21 carried on the potentiometer 9. Thus rotation of the adjustment member 11 through the window 44 allows the potentiometer 9 to be set and with it the output temperature of the blow dryer.

The adjustment member 12 is formed with an outwardly projecting boss 42 that can be moved from an "0" position to a "1" position and thereafter to a "2" position. At the "0" position the blow dryer is turned off. It operates at half speed at the "1" position and at full speed at the "2" position. At all of these speeds as described in detail in the above-cited copending application the output temperature for the blower at the outlet 41 remains the same. This member 12 is formed with an axially projecting formation or finger 23 extending past the synthetic-resin sleeve 22 and engaging the switch 24.

The insert 17 forms a recess 47 at the windows 43 and 44 so that the user can easily operate the device without accidentally actuating either the adjusting members 11 or 12. At the same time it is very simple for the user, whether right-handed or left-handed, to operate the controls 11 or 12 with the thumb of the hand holding the blow dryer. Thus it is not necessary to use two hands to change the setting, nor even to move the hand holding the blow dryer while adjusting it. The mounting of the adjustment members 11 and 12 rotationally on the cylindrical casing 14 of the motor 4 allows the entire assembly to be extremely compact, while at the same time having the most advanced features and very easy operation.

I claim:

1. A blow dryer comprising:

a housing having a slim handle shaped to be held in the hand and formed with a window, and a large head formed with an outlet;

blower means including an electric motor in said handle having an output shaft extending into said head and a motor casing formed generally as a body of revolution, and a fan mounted in said head on said shaft and rotatable by said motor to blow air from said outlet;

heater means in said housing electrically energizable to heat the air blown by said fan;

a variable circuit element connected to one of said means;

circuit means connectable to a source of electricity and to said circuit element and connected to said one means for varying the energization thereof;

an annular adjustment member carried on and coaxially surrounding said motor casing and rotatable about the axis thereof, said member being exposed at and operable through said window; and a formation on said member linking same to said circuit element for operation of said one means by said adjustment member.

2. The dryer defined in claim 1 wherein said adjustment member is formed at least partially as a ring surrounding and riding on said motor casing.

3. The dryer defined in claim 2 wherein said motor casing is substantially cylindrical and said housing forms at least one inwardly open groove around said housing at said window, said member riding in said groove.

4. The dryer defined in claim 3 wherein said output shaft extends along said axis in line with said handle, said handle having an end remote from said head formed with an inlet, said handle forming an inlet passage over said circuit and past said motor to said fan, whereby on driving of said fan by said motor air is sucked in through said inlet and passes along said passage to be expelled at said outlet.

5. The dryer defined in claim 3, further comprising a second such adjustment member, a second such circuit element independent of the first-mentioned circuit element and connected to said motor, and a second such formation interconnecting said second member with said second element, said first element being connected to said heater means.

6. The dryer defined in claim 5 wherein said outlet faces forwardly and said handle is formed with two such windows each exposing a respective member and both opening backwardly.

7. The dryer defined in claim 6 wherein said first circuit element is a potentiometer and said second element is a switch.

8. The dryer defined in claim 6 wherein said members are formed as coaxial similar sleeves each surrounding a respective half of said motor.

9. The dryer defined in claim 8 wherein said motor is substantially only exposed through said sleeves at its axial ends.

10. The dryer defined in claim 1 wherein said circuit element is a rotary control having a gear and said formation is gear teeth meshing with said gear and carried on said member.

* * * * *